US007522849B2

(12) United States Patent
Suzuki et al.

(10) Patent No.: US 7,522,849 B2
(45) Date of Patent: Apr. 21, 2009

(54) IMAGE FORMING APPARATUS WITH BELT RECOGNITION DEVICE

(75) Inventors: Takayuki Suzuki, Kashiwa (JP); Tatsuya Goto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/470,144

(22) Filed: Sep. 5, 2006

(65) Prior Publication Data

US 2007/0058992 A1 Mar. 15, 2007

(30) Foreign Application Priority Data

Sep. 13, 2005 (JP) ..... 2005-266128

(51) Int. Cl.
*G03G 15/00* (2006.01)

(52) U.S. Cl. ..... 399/12; 340/676

(58) Field of Classification Search ..... 399/12; 340/676

See application file for complete search history.

(56) References Cited

U.S. PATENT DOCUMENTS 4,577,953 A * 3/1986 Narukawa ..... 399/36
5,689,756 A * 11/1997 Taki et al. ..... 399/33
5,740,492 A * 4/1998 Deki et al. ..... 399/66
2005/0244190 A1 * 11/2005 Omata et al. ..... 399/121

FOREIGN PATENT DOCUMENTS

| | | |
|---|---|---|
| JP | 5-150574 | 6/1993 |
| JP | 10-282809 | 10/1998 |
| JP | 2000-66562 | 3/2000 |
| JP | 2000-132048 | 5/2000 |
| JP | 2001-5527 | 1/2001 |
| JP | 2002-132055 | 5/2002 |

* cited by examiner

*Primary Examiner*—David M Gray
*Assistant Examiner*—Bryan Ready
(74) *Attorney, Agent, or Firm*—Fitzpatrick, Cella, Harper & Scinto

(57) ABSTRACT

The image forming apparatus includes a rotary belt member; a detector for detecting a position in a rotating direction of the belt member; a toner image forming device for forming a toner image at a predetermined position on the belt member based on a detection signal of the detector; and a recognition device for recognizing the type of belt member based on the detection signal. The apparatus is stopped or the information related to the belt member is notified based on the recognition result of the recognition device. Thus, by a simple configuration, failures caused by an unsuitable rotary belt member can be easily prevented.

18 Claims, 11 Drawing Sheets

IMAGE FORMING APPARATUS WITH BELT RECOGNITION DEVICE

BACKGROUND OF THE INVENTION

1. Field of the Invention

The present invention relates to an image forming apparatus including a belt member which is put on a stretching member with tension and can be endlessly moved.

2. Description of the Related Art

It is conventionally known in image forming apparatuses such as a copying machine and a printer for forming a color image to superimpose monochromatic toner images (e.g., yellow, magenta, cyan, black) of different colors by way of a belt member to form a full color image.

An intermediate transfer method, direct recording method and the like are known as a method of superimposing the toner images on the belt member. For example, in describing an image forming apparatus using four different color toners as an example, the image forming apparatus of the intermediate transfer method or direct transfer method may be a so-called 4-drum system or 1-drum system.

In further describing the image forming apparatus of the intermediate transfer method, in the 4-drum system, a plurality of image forming units for forming the toner image each has a photosensitive drum and forms a monochromatic toner image. The toner images are superimposed on the intermediate transferring belt to form a full color image. In the 1-drum system, the monochromatic toner image of the first color is first formed by a plurality of developers and one photosensitive member, and the toner image is transferred onto the intermediate transferring belt. Thereafter, the developer is sequentially changed, and the toner image of different color is similarly sequentially superimposed onto the intermediate transferring belt to form the full color image. In a case of the direct transfer method, the toner image is directly transferred and superimposed from the photosensitive drum 1 onto the recording material borne on the recording material bearing member instead of the intermediate transferring member.

In most of the image forming apparatuses of 1-drum system, a position detection mark (home position mark) is provided in a non-image region of the belt member, and a position detecting sensor (home position sensor) for reading the home position mark is arranged. This is because a so-called registration, or accurately aligning and superimposing the toner image of each color, is necessary in the 1-drum system. In other words, registration is performed by starting the image forming process of each color with the home position detection of the intermediate transferring belt as the reference.

In the 4-drum system, image aligning (registration) of each color such as in the 1-drum system is generally not performed. Normally, each image forming unit of each color forms a registration mark on the belt member before performing image formation. A registration sensor for detecting the registration mark is arranged in the image forming apparatus. The registration position shift amount of each color is obtained from the registration mark detection result of the registration sensor, and the registration position is corrected.

In the 4-drum system, the image forming unit of each color of yellow, magenta, cyan, and black is normally arranged in one row along the outer peripheral surface of the belt member. The belt member is generally put on rollers serving as a plurality of stretching members with tension. A drive roller out of the rollers drives the belt member and the belt member moves (travels) endlessly.

The belt member generally tends to have an uneven thickness in the longitudinal direction (traveling direction) due to manufacturing causes. Thus, speed variation occurs with one rotation of the belt member as one cycle even if the rotation speed of the drive roller for driving the belt member is controlled to a constant.

Since each image forming unit is arranged in one row along the outer periphery of the belt member as described above, the timings to start the image forming process of each image forming unit differ from each other according to the respective distance from the drive roller. Thus, image alignment of each color becomes very difficult when the speed variation caused by variation in the thickness of the belt member occurs as described above.

In the 4-drum system, a home position mark is provided on the belt member as a method of avoiding speed variation caused by variation in thickness. In other words, the thickness variation profile of the belt member is measured in advance in relation to the absolute position on the belt member determined from the home position mark. The image forming timing of each color and the rotation speed of the drive roller are controlled based on the thickness variation profile, so that the image alignment (registration) of each color is accurately performed.

The art for providing a reference mark on the belt member includes techniques disclosed in Japanese Patent Application Laid-Open No. 2000-132048 and Japanese Patent Application Laid-Open No. H05-150574.

Recently, upgrading the version of the image forming apparatus is being attempted for the purpose of further enhancing the image quality and of enhancing productivity with substantially the same cross-sectional configuration. Lowering the cost by changing the material and the like is also being attempted. Thus, difference in models tends to occur due to such changes.

When such change is effected, the change in the image forming process such as change in toner formulation and change in transfer property is often required. In components such as the intermediate transferring belt, the die is common, and the change is often effected by changing the material of the belt material, the method of processing the surface and the like. This is because the difficulty level of manufacturing the die is extremely high.

In this case, the belt member has exactly the same shape, and thus is very difficult to distinguish the difference based on outer appearance. As it is normally difficult to continuously maintain the transfer property until the intermediate transferring belt reaches the product life time of the image forming apparatus, the intermediate transferring belt is configured so as to be easily exchanged in the market. Troubles such as image defect occur if, for example, the intermediate transferring belt is arranged in a different model by mistake. In the worst case, the image forming apparatus may breakdown.

Japanese Patent Application Laid-Open No. 2001-005527 discloses a method of arranging a recognition display for indicating the transfer property in the intermediate transferring belt, arranging a detecting means for detecting the recognition display in the image forming apparatus main body, and controlling the transfer condition according to the detection result of the detecting means.

However, the conventional method of determining whether or not the belt member is suited to the image forming apparatus involves increase in cost and size of the apparatus.

SUMMARY OF THE INVENTION

An object of the present invention is to provide an image forming apparatus for easily preventing failures that occur when the mounted belt member is not suitable with a simple configuration.

Another object of the present invention is to provide an image forming apparatus including a belt member which rotates, a detecting member for detecting a position in a rotating direction of said belt member, a toner image forming member for forming a toner image at a predetermined position on said belt member based on a detection signal of said detecting member, a recognition member for recognizing a type of said belt member based on the detection signal and a stop member for stopping said image forming apparatus based on the recognition result of said recognition member.

A further object of the present invention also is to provide an image forming apparatus including a belt member which rotates, a detecting member for detecting a specific position in a rotating direction of said belt member, a toner image forming member for forming a toner image at a predetermined position on said belt member based on a detection signal of said detecting member, a recognition member for recognizing a type of said belt member based on the detection signal, and a notification member for notifying information related to said belt member based on the recognition result of said recognition member.

A still further object of the present invention will become apparent from the following description of exemplary embodiments (with reference to the attached drawings).

DESCRIPTION OF THE EMBODIMENTS

The image forming apparatus according to the present invention will now be described in detail in accordance with the drawings.

EXAMPLE 1

<Overall Configuration of Image Forming Apparatus>

Figure 1:
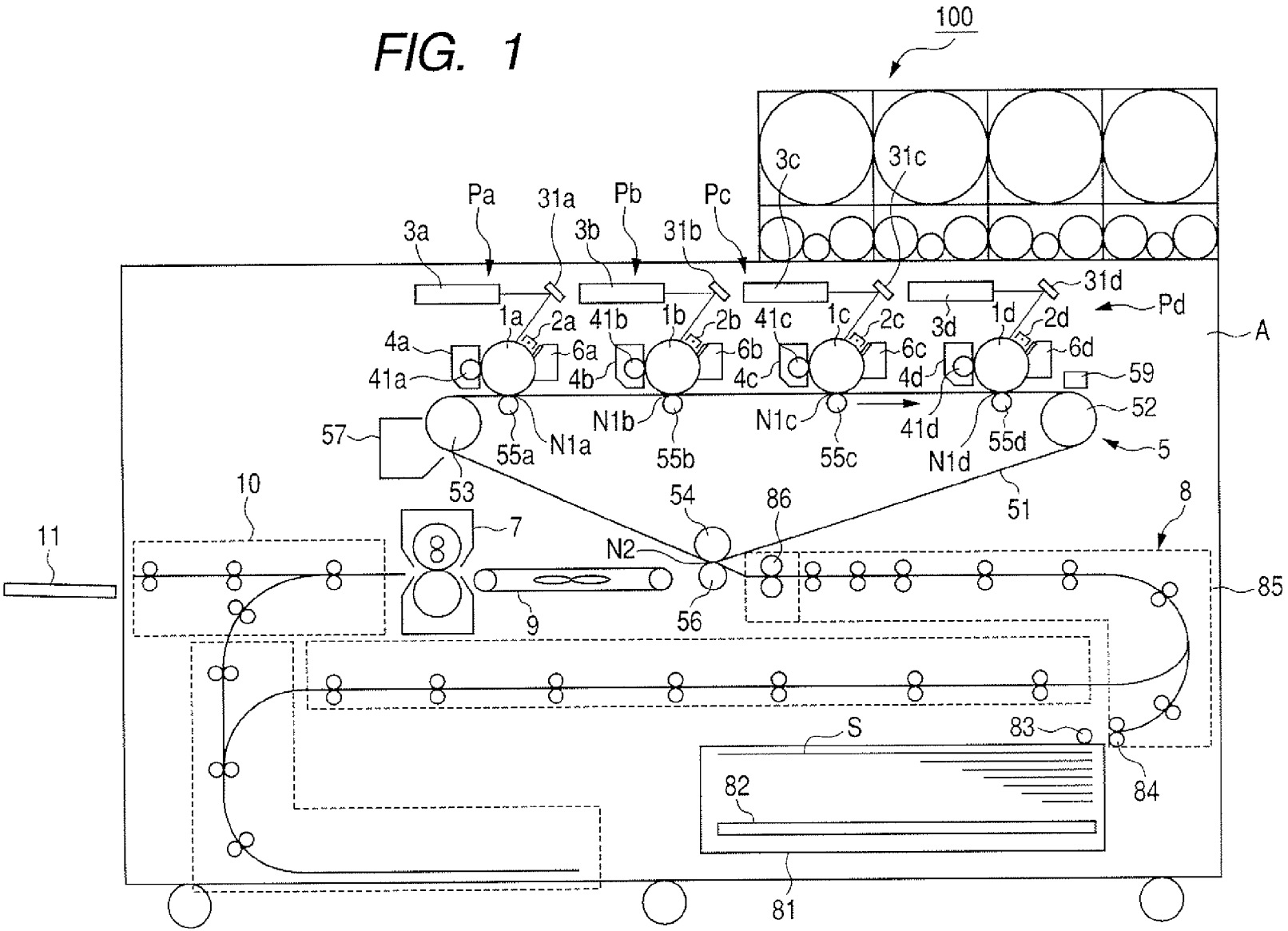
FIG. 1 is a main cross-sectional view of one embodiment of an image forming apparatus according to the present invention.

FIG. 1 is a main cross-sectional view of one embodiment of the image forming apparatus according to the present invention. The image forming apparatus 100 of the present example is a so-called 4-drum type laser beam printer for forming a full color image on a recording material (recording paper, OHP sheet, cloth, etc.) using an electrophotographic method.

The image forming apparatus 100 has first, second, third, and fourth image forming sections (stations) Pa, Pb, Pc, and Pd for forming an image of yellow, magenta, cyan, and black as image forming means (toner image forming devices) for forming the toner image.

In the present example, the configurations of each image forming section Pa, Pb, Pc, and Pd are the same except for the color of the toner used. Therefore, unless distinction is particularly required, the suffixes a, b, c, and d attached to the reference numerals to indicate the element for one of the colors will not be described, and explanation will be made as a whole.

A cylindrical photosensitive member, that is, a photosensitive drum 1 is arranged in the image forming section P as an image bearing member. A primary charging device 2 serving as a primary charging means, and a laser scanner 3 serving as an exposure means are arranged around the photosensitive drum 1. Furthermore, a developer 4 serving as a developing means, and a cleaning device 6 serving as a cleaning means are arranged around the photosensitive drum 1. An intermediate transfer unit 5 is arranged facing the photosensitive drums 1*a* to 1*d* of each image forming section Pa to Pd.

As hereinafter described in detail, the intermediate transfer unit 5 has an intermediate transferring belt 51 serving as an intermediate transferring member. The intermediate transferring belt 51 is bridged across three rollers, drive roller 52, tension roller 53, and secondary transfer inner roller 54, serving as a plurality of stretching members. When the driving force is transmitted to the drive roller 52, the intermediate transferring belt (belt member) 51 endlessly moves (travels) in the direction (clockwise direction) shown with an arrow in the figure. Primary transfer rollers 55*a* to 55*d* serving as primary transfer means are arranged at positions facing the photosensitive drums 1*a* to 1*d* of each image forming section Pa to Pd on the inner peripheral side of the intermediate transferring belt 51. The primary transfer sections (primary transfer nips) N1*a*, N1*b*, N1*c*, and N1*d* at a position where the intermediate transferring belt 51 contacts the photosensitive drum 1 are formed as each primary transfer roller 55*a* to 55*d* pushes the intermediate transferring belt 51 towards the photosensitive drums 1*a* to 1*d*. Furthermore, a secondary transfer outer roller 56 is arranged at a position facing the secondary transfer inner roller 54 by way of the intermediate transferring belt 51. The intermediate transferring belt 51 is then sandwiched by the secondary transfer inner roller 54 and the secondary transfer outer roller 56 configuring the secondary transfer means. A secondary transfer section (secondary transfer nip) N2 at a position where the intermediate transferring belt 51 and the secondary transfer outer roller 56 contact is thereby formed.

The photosensitive drum 1 is rotatably driven at a predetermined peripheral speed (process speed) in the direction (counterclockwise direction) shown with an arrow in the figure. The peripheral surface of the photosensitive drum 1 is charged (primary charge) to a predetermined polarity and potential by the primary charging device 2. The image information sent by a personal computer and the like is converted to an electrical signal in an image processing section (not shown), and transmitted to the laser scanner 3. The laser light source (not shown) of the laser scanner 3 emits the laser light corresponding to the image information. The laser light is scanned by an image signal write optical system (not shown), folded by a folding mirror 31 towards the photosensitive drum 1, and imaged onto the photosensitive drum. An electrostatic image (latent image) is thereby formed on the photosensitive drum 1.

The electrostatic image formed on the photosensitive drum 1 becomes visible as a toner image by the developer 4. In the present example, the developer 4 accommodates 2-component developer including non-magnetic resin toner particles (toner) and magnetic carrier particles (carrier) as the developer. The developer 4 has a developing sleeve 41 serving as a developer bearing member arranged facing the photosensitive drum 1. The electrostatic image on the photosensitive drum 1 is developed by supplying the toner to the photosensitive drum 1 from the developer borne on the developing sleeve 41.

The toner image on the photosensitive drum 1 developed by the developer 4 is transferred (primary transfer) onto the intermediate transferring belt 51 by means of the primary transfer roller 55 in the primary transfer section. A predetermined primary transfer bias is applied from the primary transfer bias power supply to the primary transfer roller 55 at this point.

The residual toner on the photosensitive drum 1 after the primary transfer step is scraped and collected by the cleaning device 6. The surface of the photosensitive drum 1 is thereby cleaned and is repeatedly used for image formation.

For example, the above-described operations are sequentially performed in the first to the fourth image forming sections Pa to Pd in the full color image formation. The toner image of each color is superimposed and transferred onto the intermediate transferring belt 51 in each primary transfer section N1*a* to N1*d*. The toner image is sequentially transferred onto the intermediate transferring belt 51 and the full color toner image is formed on the intermediate transferring belt 51.

The recording material S is conveyed from the recording material supply section 8 to the secondary transfer section N2 so as to synchronize with the toner image on the intermediate transferring belt 51. In other words, in the recording material supply section 8, the recording material S is set in the cassette 81 and accommodated in the image forming apparatus main body (apparatus main body) A. When the cassette 81 is set in the apparatus main body A, the lifter 82 in the cassette 81 is raised by the lifter motor (not shown), and the surface of the recording material S is also raised therewith so as to be supplied. The recording material S starts to move by the rotation of the supply roller 83, and then is separated one by one by the separation roller pair 84, and conveyed to a registration roller 86 through a conveying roller train 85. The recording material S having the registration (positional shift) corrected by the registration roller 86 is then conveyed to the secondary transfer section N2.

The full color toner image formed on the intermediate transferring belt 51 is transferred (secondary transfer) onto the recording material S in the secondary transfer section N2 between the secondary transfer inner roller 54 and the secondary transfer outer roller 56. An electric field is generated at this point between the secondary transfer inner roller 54 and the secondary transfer outer roller 56 in the secondary transfer section N2. By applying a predetermined secondary transfer bias from the secondary transfer bias power supply to either the secondary transfer inner roller 54 or the secondary transfer outer roller 56, the electric field can be generated between the relevant rollers.

The residual toner on the surface of the intermediate transferring belt 51, after the secondary transfer step is terminated and the recording material S is separated, is collected by a belt cleaning device 57. The intermediate transferring belt 51 is thereby repeatedly used for image formation.

The recording material S transferred with the toner image is stripped from the intermediate transferring belt 51 by a charge separator (not shown). The recording material S is then conveyed to a fixing device 7 through the conveying section 9. The fixing device 7 fixes the toner image on the recording material S thereto by heat or pressure. Thereafter, the recording material S is discharged to a discharge tray 11 exterior to the apparatus by a discharge roller train 10. The printing operation on one surface of the recording material S is thereby terminated.

The image forming apparatus 100 may also form an image of a desired color such as black only image using only the desired image forming section. In this case, the image forming steps similar to the above are performed only in the desired image forming section to form only the toner image of the desired color on the intermediate transferring belt 51. The toner image is fixed to the recording material S after being transferred thereto.

<Intermediate Transfer Unit>

Figure 2:
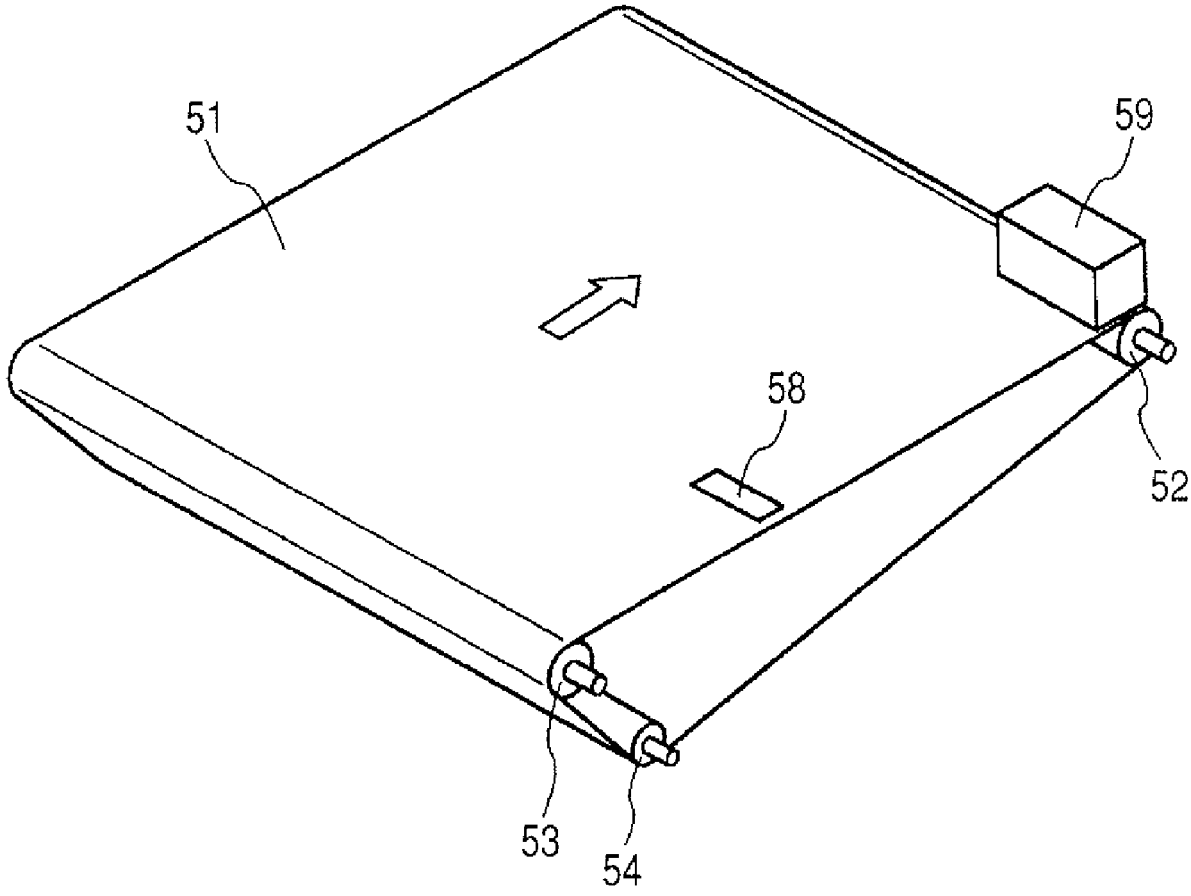
FIG. 2 is a perspective view of an outer appearance of the main parts of an intermediate transfer unit arranged in the image forming apparatus of FIG. 1.
Figure 3:
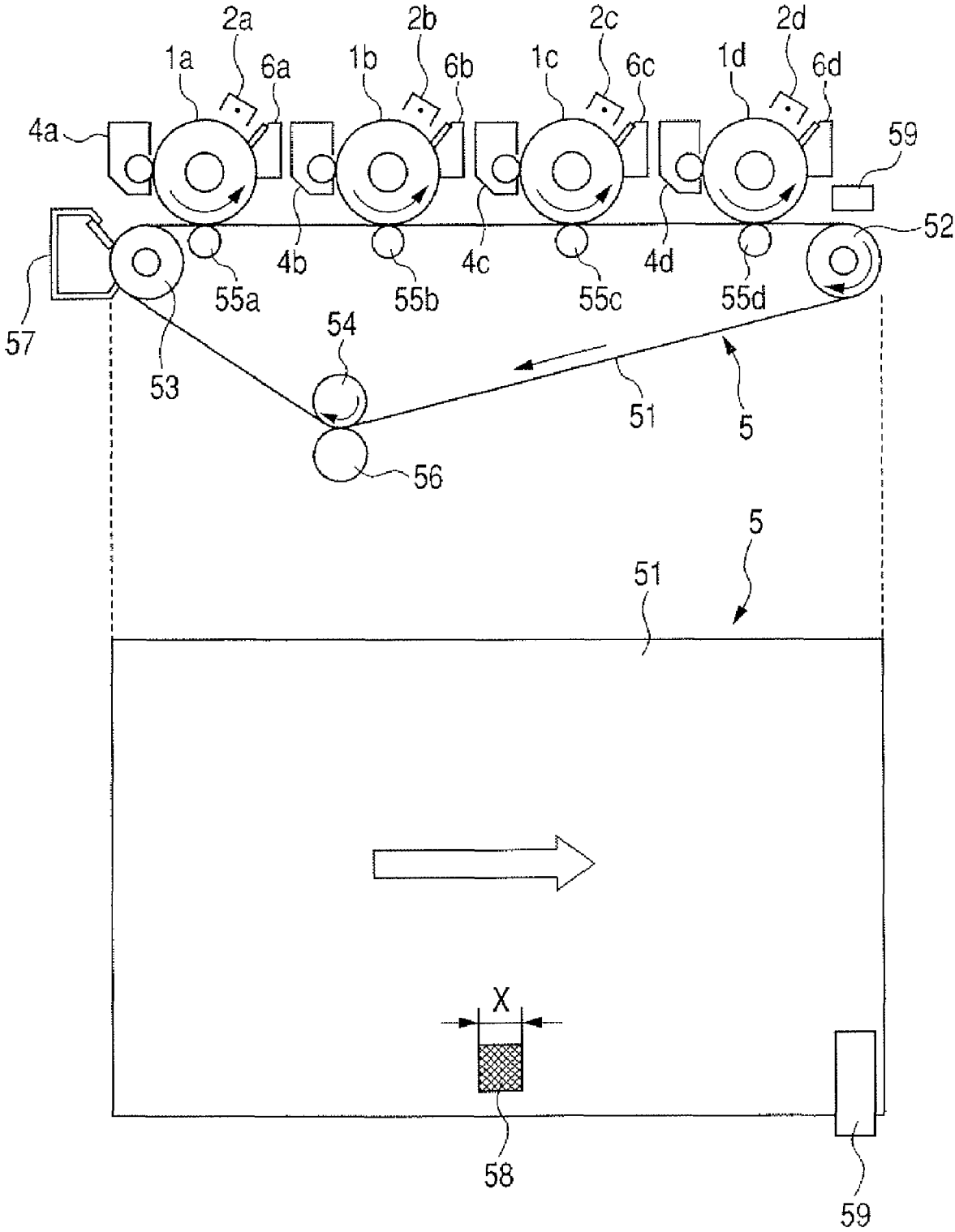
FIG. 3 is a cross-sectional view and a top view of the surrounding of the intermediate transferring belt for explaining one example of a home position mark.

The intermediate transfer unit (intermediate transfer section) 5 will now be described in detail. FIG. 2 is a perspective view of an outer appearance of the main parts of the intermediate transfer unit 5. FIG. 3 is a cross-sectional view and a top view of the surrounding of the intermediate transfer unit 5.

As described above, the intermediate transferring belt 51 is stretched across three rollers of the drive roller 52, the tension roller 53, and the secondary transfer inner roller 54. The three rollers 52, 53, 54 are held by a frame (not shown) and form the intermediate transfer unit 5. The intermediate transferring belt 51 is configured so as to be changeable with respect to the three rollers 52, 53, 54 by loosening the tension of the tension roller 53. The intermediate transferring belt 51 is also removable with respect to the apparatus main body A as the intermediate transfer unit 5 while being held by the frame.

A home position mark (detected part) indicating the absolute position reference in the moving direction of the intermediate transferring belt 51 is formed in the non-image region at the end in the direction intersecting the moving direction (traveling direction) of the intermediate transferring belt 51. A home position sensor (detecting means) 59 for detecting the home position mark 58 is arranged in the apparatus main body A.

The home position sensor 59 is a light reflection type sensor and has a light emitting part and a light receiving part. The home position sensor 59 is arranged at a position capable of reading the home position mark 58 on the outer peripheral side of the intermediate transferring belt 51.

The home position mark 58 is formed as a high reflectivity part or a low reflectivity part with respect to the intermediate transferring belt 51. In the present example, the home position mark 58 is configured so as to have a higher reflectivity than the surface of the intermediate transferring belt 51. The home position mark 58 includes that of seal form to be attached to the surface of the belt member, that which is directly written onto the surface of the belt member, and that obtained by cutting out one part of the belt member. The seal having a higher reflectivity than the surface of the intermediate transferring belt 51 is attached in the present example.

When the intermediate transferring belt 51 travels and the home position mark 58 passes the home position sensor 59, change occurs from the low reflectivity part to the high reflectivity part or from the high reflectivity part to the low reflectivity part.

Figures 4A, 4B:
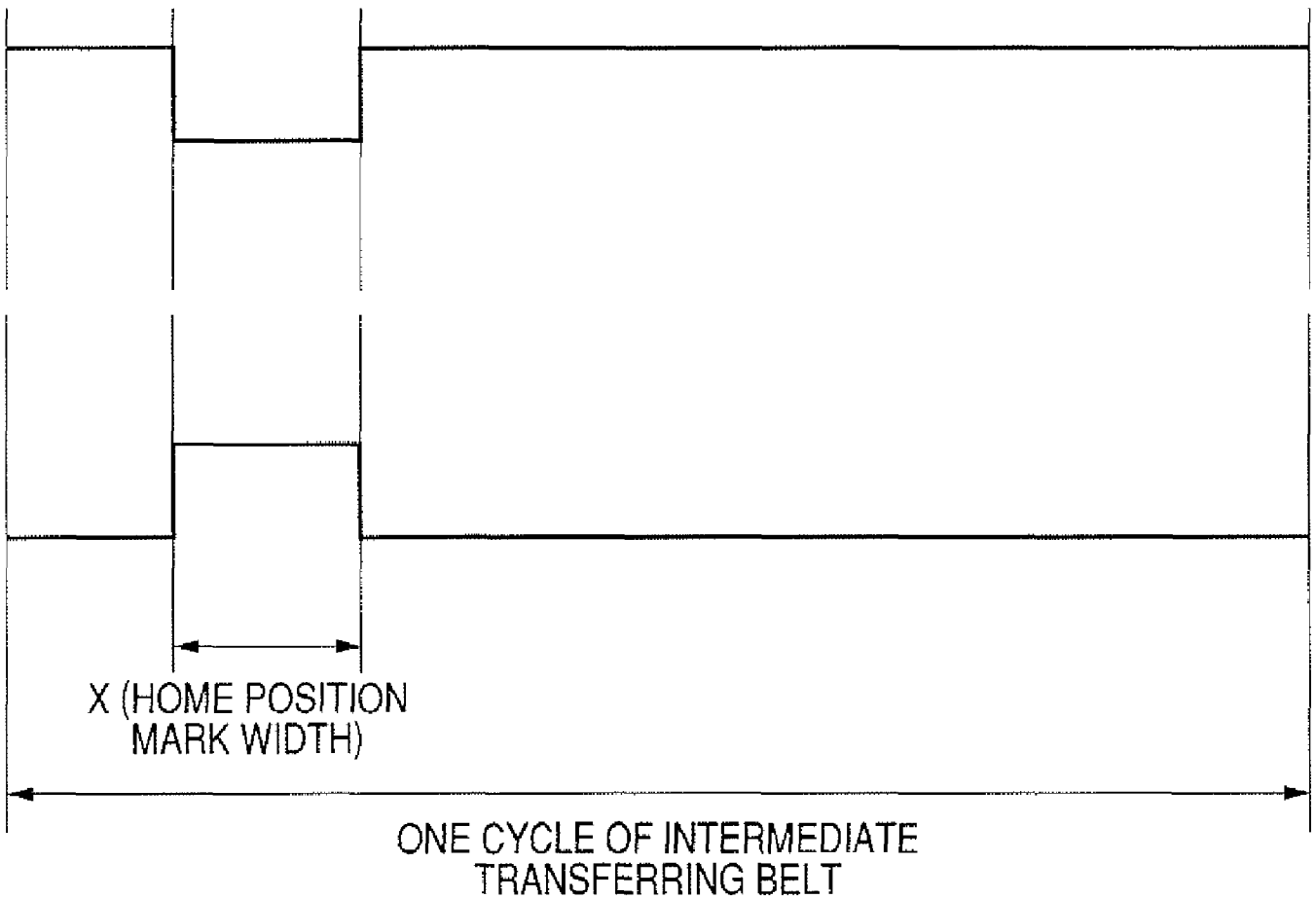
FIGS. 4A and 4B are explanatory views showing one example of an output of a home position sensor.

FIGS. 4A and 4B are views showing the output of the home position sensor 59 when detecting the high reflectivity part at the home position mark section and when detecting the low reflectivity part at the home position mark section. In the present example, the home position sensor 59 outputs High voltage when detecting the high reflectivity part and outputs Low voltage when detecting the low reflectivity part. Thus, the output value of the home position sensor 59 corresponding to such change is obtained as shown in FIG. 4B. The output voltage difference of the home position sensor 59 is 5V in the present example. As shown in FIG. 4A, the home position sensor 59 may output Low voltage when detecting the high reflectivity part and output High voltage when detecting the low reflectivity part.

Furthermore, the time required for the intermediate transferring belt 51 to travel one round is about seven seconds in the present example. Thus, the home position mark 58 passes the home position sensor 59 about every seven seconds. The home position sensor 59 thus outputs the signal in the above manner in such cycle.

Figure 5:
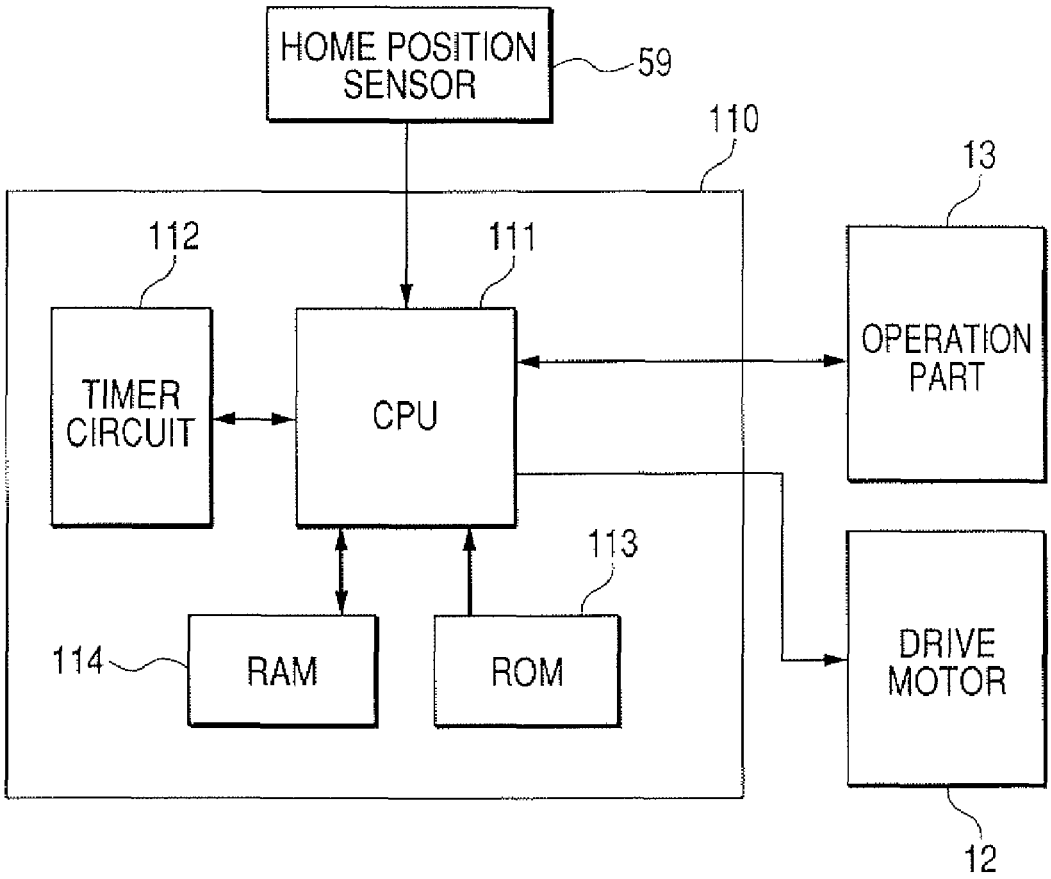
FIG. 5 is a schematic block diagram showing a control mode of suitability determination control of a belt member according to the present invention.

FIG. 5 is a schematic control block diagram according to the present example. The control part 110 has a CPU 111 which is the central element of control, a timer circuit 112, ROM 113 and RAM 114 serving as a storing means and the like.

The output signal of the home position sensor 59 is input to the control part 110 of the apparatus main body A.

In the control part 110 of the apparatus main body A, the output of the home position sensor 59 is first recognized as the positional reference of the intermediate transferring belt 51. In other words, the CPU 111 of the control part 110 first detects the information on the absolute position in the moving direction of the intermediate transferring belt 51 from the output signal of the home position sensor 59. The CPU 111 then recognizes the home position mark 58 as the positional reference of the intermediate transferring belt 51 and performs various controls on the intermediate transferring belt 51.

The above-described image formation is performed based on the detection result of the home position mark 58. That is, the timing the electrostatic image is formed on the photosensitive drum 1, the position the toner image is formed on the intermediate transferring belt 51 and the like are controlled based on the detection result of the home position mark 58.

The intermediate transferring belt 51 causes thickness variation in the manufacturing process, as mentioned above. Thus, the profile on the thickness variation is created with the home position mark 58 as the reference, and stored in the ROM 113. The CPU 111 controls the drive motor 12 serving as a drive means of the drive roller 53 and controls the rotation speed of the drive roller 53 based on the profile. The CPU 111 can control the image forming process timing of each color based on the profile. Thus, the position shift of each color caused by speed variation of the intermediate transferring belt 51 due to the thickness variation can be corrected. The control itself of the image forming operation may appropriately use anything that is available.

According to the present example, the output of the home position sensor 59 is further used in the control part 110 of the apparatus main body A to determine whether or not the intermediate transferring belt 51 mounted on the apparatus main body A is suitable for the relevant apparatus main body A.

That is, one aim of the present invention is to be able to determine the type of the belt member with the home position sensor 59 without adding a dedicated belt member determining means to the apparatus main body A.

In the present example, the home position mark 58 for displaying the absolute position on the intermediate transferring belt 51 is arranged on the intermediate transferring belt 51 serving as the belt member. The home position sensor 59 for detecting the home position mark 58 is arranged in the apparatus main body A. A means for detecting the information on the type of the intermediate transferring belt 51 from the variation mode of the output signal of the home position sensor 59 is arranged in the apparatus main body A.

A storing means for storing the reference signal (reference output value) contradistinguished to the detection result of the variation mode of the output signal of the home position sensor 59 is further arranged in the apparatus main body A. Moreover, a comparison means for comparing the detection result of the variation mode of the output signal of the home position sensor 59 and the reference signal stored in the storing means is arranged in the apparatus main body A.

The CPU 111 of the control part 110 has a function of the means for detecting the variation mode of the output signal of the home position sensor 59 in the present example. Furthermore, in the present example, the CPU 111 has a function of the comparison means (comparator). The CPU 111 also has a function of the recognition means for recognizing the type of the intermediate transferring belt 51 based on the detection signal of the home position sensor 59. The reference signal is stored in advance in the ROM 113 serving as the storing means. In the present example, the CPU 111 outputs a signal for notifying that the intermediate transferring belt 51 is not complied (unsuitable) to the apparatus main body A when the detection result of the variation mode of the output signal of the home position sensor 59 and the reference signal stored in the ROM 113 do not match.

Therefore, the image forming apparatus 100 has the portion to be detected (home position mark) 58 and the rotating belt member (intermediate transferring belt) 51, in the present example. The image forming apparatus 100 further has the home position sensor 59 as a detecting means for detecting the home position mark 58. Thus, the toner image forming device (image forming section) P forms the toner image at a predetermined position on the belt member 51 based on the detection signal of the home position sensor 59. The image forming apparatus 100 further has the comparison means (CPU) 111 for comparing the detection signal and the reference signal. In the present example, the image forming apparatus 100 has a means for notifying the information on the comparison result based on the comparison result of the comparison means (111). That is, the image forming apparatus 100 has a means for notifying the information related to the belt member 51 obtained from the detection signal of the home position sensor 59. This will be further described in detail below.

The home position mark 58 includes that of seal form to be attached to the surface of the belt member, that which is directly written onto the surface of the belt member, and that obtained by cutting out one part of the belt member. In either case, the home position mark 58 has a width X in the traveling direction of the belt member, as shown in FIG. 3.

In a case where one home position mark 58 is arranged on the intermediate transferring belt 51, the signal changes between portions having different reflectivity such as from the high reflectivity part to the low reflectivity part, or from the low reflectivity part to the high reflectivity part when the home position mark 58 is detected by the home position sensor 59. In the present example, the signal changes at two locations as shown in FIG. 4B. The CPU 111 measures the interval time between the two locations where the signal changes by means of the timer circuit 112. The CPU 111 recognizes the width X of the home position mark 58 from the interval time and the travel speed (process speed, surface movement speed) of the intermediate transferring belt 51.

The width X of the home position mark 58 is thus recognized in the apparatus main body A. The type of the intermediate transferring belt 51 can be recognized in the apparatus main body A by changing the width X of the home position mark 58.

For example, the width X of all the home position marks 58 is the same for the same model and the same version, and the width X is different for different model and different version. On the apparatus main body A side, the reference signal corresponding to the width X of the home position mark 58 of the intermediate transferring belt 51 that adapts to the apparatus main body A is stored in the ROM 113. Thus, determination is made on whether or not the mounted intermediate transferring belt 51 accords with the apparatus main body A on the apparatus main body A side. That is, the width X of the home position mark 58 is unique to the type of the intermediate transferring belt 51 corresponding to the suitability with respect to the apparatus main body A.

Normally, the image forming apparatus performs pre-rotation for self diagnosing whether or not problems are found inside the equipment such as in power ON. The pre-rotating operation for rotating each member of the image forming section P such as the photosensitive drum 1 and the intermediate transferring belt 51 is normally performed to clean the surface of the intermediate transferring belt 51. Thus, the home position mark 58 can be detected in such pre-rotating operation before the image forming operation. Alternatively, the attachment and detachment of the intermediate transferring belt 51 or the intermediate transfer unit 5 may be detected by the control part 110 of the apparatus main body A, and the pre-rotating operation may be forcibly performed.

In other words, the intermediate transferring belt 51 may be exchanged in the market when its life time is reached, as described above. The intermediate transferring belt 51 of different model and different version exists, and a check for the suitability of the intermediate transferring belt 51 can be performed in time of the pre-rotating operation even if mistakenly applied to the apparatus main body A. When the intermediate transferring belt 51 not suited to the apparatus main body A is mounted, this may be notified at this point in the operation part 13 and the like of the apparatus main body A. Notification may be made in the display section and the like of the equipment communicatably connected to the apparatus main body A.

In the present example, the CPU 111 has a function of a notification means for outputting (transmitting) the signal for notifying that the intermediate transferring belt 51 not suited to the apparatus main body A is mounted to equipment and the like communicatably connected to the operation part 13 of the apparatus main body A or the apparatus main body A. Furthermore, in the present example, the operation section 13 arranged in the apparatus main body A configures the notification means for notifying that an unsuitable intermediate transferring belt 51 has been mounted. The belt device is configured including the intermediate transferring belt 51 with the home position mark 58, the home position sensor 59, as well as the comparison means and the notification means described above.

Figure 6:
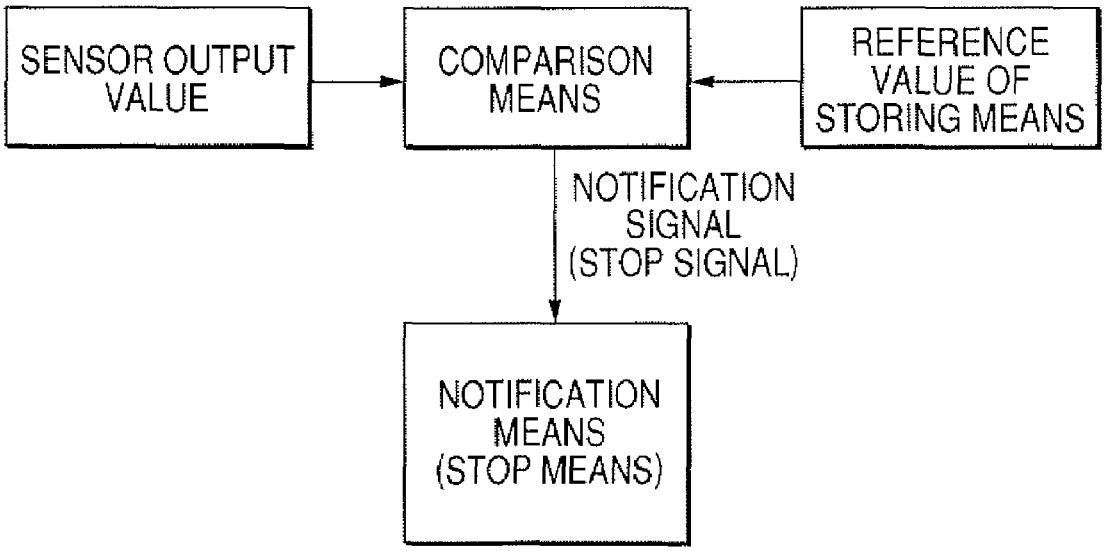
FIG. 6 is a frame format view showing a signal processing flow in the suitability determination control of the belt member according to the present invention.
Figure 7:
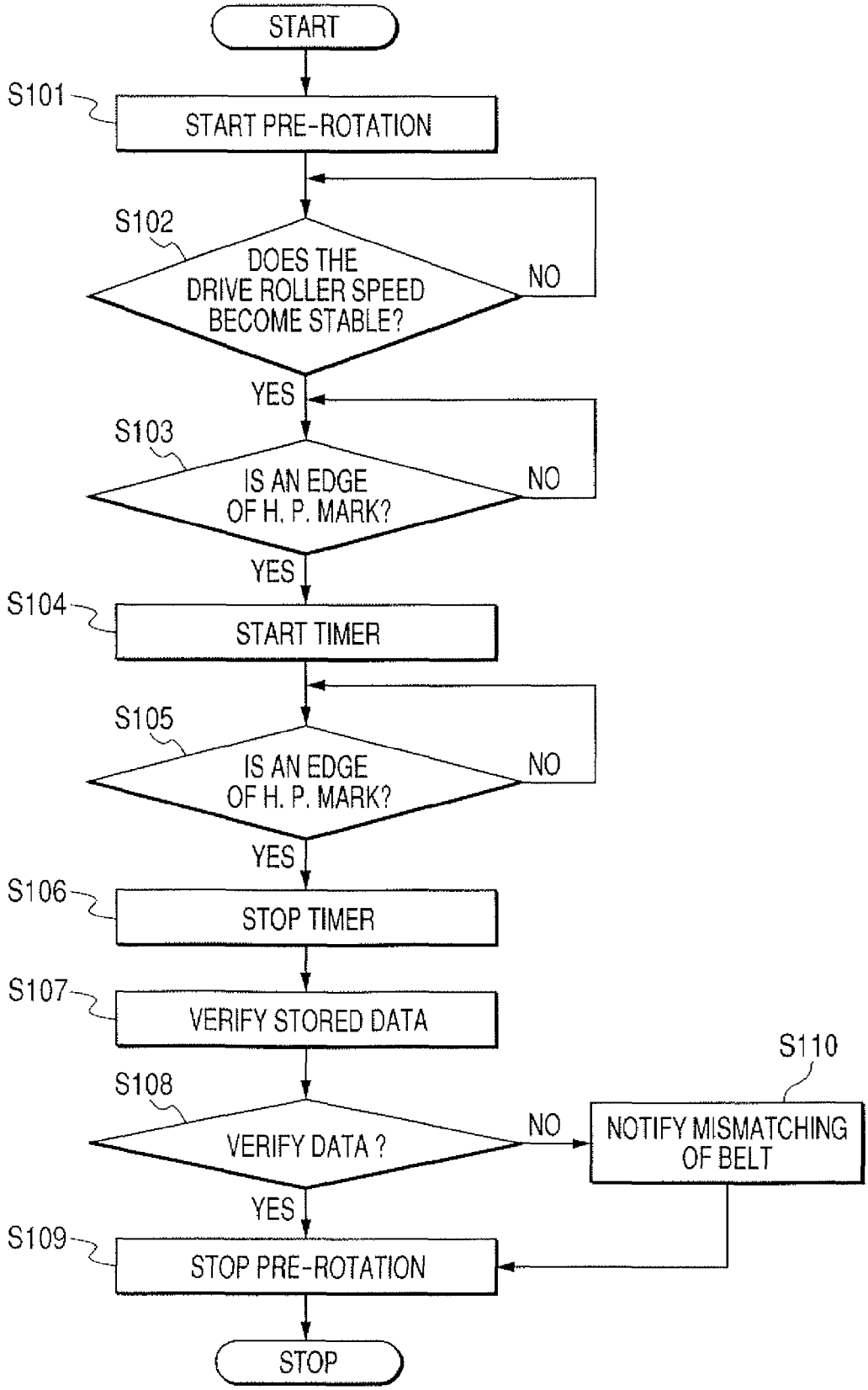
FIG. 7 is a flow chart showing an operation procedure of the suitability determination control of the belt member according to the present invention.
Figure 8:
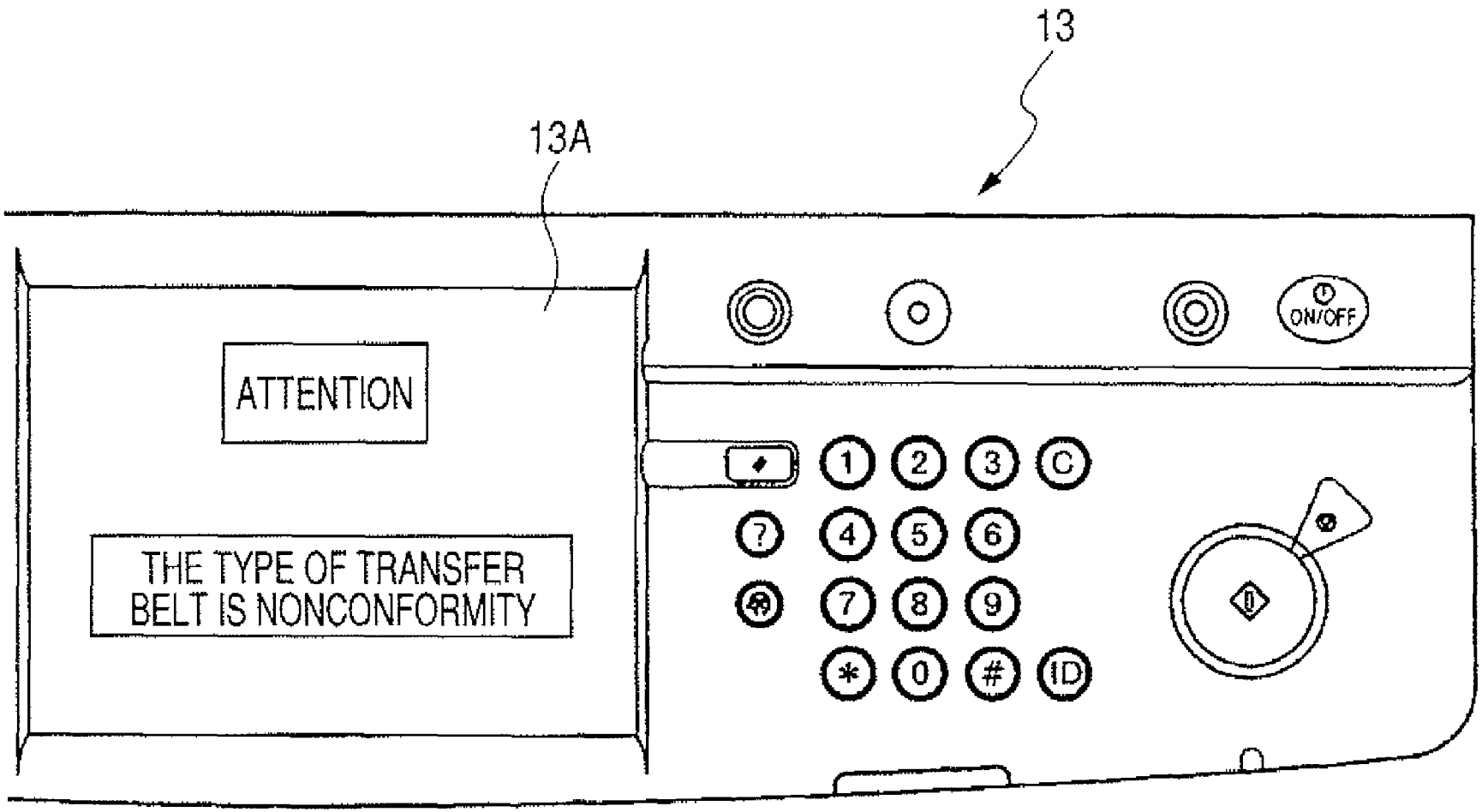
FIG. 8 is a view showing one example of a display in an operation section.

FIG. 6 is a frame format view showing the flow of the signal process such as the detection result (sensor output value), the reference signal (reference value of storing means), and the notification signal, in the control of the present example. In the figure, the signal process flow in example 3 to be hereinafter described is also shown. FIG. 7 is a flow chart showing the control of the present example. FIG. 8 shows a display example when the unsuitability of the intermediate transferring belt 51 is notified on the display section 13A of the operation part (notification means) 13.

The CPU (comparison means, recognition means, notification means) 111 starts the pre-rotation (S101) when the power of the image forming apparatus 100 is turned ON. The CPU 111 monitors (S102) the rotating speed of the drive roller 52 to stabilize. After the rotation speed of the drive roller 52 stabilizes, the CPU 111 detects the rising edge of the output signal from the home position sensor 59 (S103) and transmits an activation signal to the timer circuit 112 to start the measurement of time (S104). The CPU 111 then detects the falling edge of the output signal of the home position sensor 59 (S105) and transmits the stop signal to the timer circuit 112 to stop the measurement of time (S106).

The data (time data) related to the time measured by the timer circuit 112 is temporarily stored in the RAM 114, as necessary, between S105 and S106. In the present example, the time data corresponds to the width X of the home position mark 58 since the intermediate transferring belt 51 is driven at a predetermined process speed. In other words, the time from the rise to the fall of the edge of the output signal is detected as a variation in the output signal of the home position sensor 59 involved in the movement of the intermediate transferring belt 51, that corresponds to the length of the home position mark 58 in the moving direction of the intermediate transferring belt 51. The time information indicates the information related to the type of the intermediate transferring belt 51.

The CPU 111 subsequently reads the reference time data stored as the reference signal in correspondence to the intermediate transferring belt 51 suited to the apparatus main body A from the ROM 113, and compares (checks) the same with the time data stored in the RAM 114 (S107). The CPU 111 stops (S109) the pre-rotation when the time data and the reference time data match (S108). The CPU 111 transmits (S110) the signal for notifying the unsuitability of the intermediate transferring belt 51 to the operation part 13 of the apparatus main body A, or the equipment communicatably connected to the apparatus main body A when the time data and the reference time data do not match (S108). The CPU 111 thereafter stops the pre-rotation (S109).

According to the present example, the difference such as in model and version of the belt member are detected by the home position sensor 59 and notified without adding a special hard configuration. Thus, the apparatus is simplified and the cost is reduced while preventing failures such as occurrence of image failure due to unsuitability of the intermediate transferring belt 51 and damage of the image forming apparatus 100. That is, according to the present example, the failures that occur when the belt member mounted on the apparatus main body A is unsuitable are prevented with a simple configuration.

EXAMPLE 2

Another example of the present invention will now be described. The basic configuration and operation of the image forming apparatus of the present example are the same as those of example 1. Therefore, the same reference numerals are denoted for elements having the same or equivalent function as the image forming apparatus of example 1, and the detailed explanation thereof will not be described. The characteristic aspects will be described in the present example.

In example 1, when the intermediate transferring belt 51 of different model and different version is mistakenly applied to the apparatus main body A, such fact is notified in the operation part 13 and the like.

The present invention is not limited thereto, and in place of or in addition to the notification, the image forming apparatus 100 may be forcibly stopped to prevent damage and the like of the equipment. In other words, in the present example, the CPU 111 outputs the signal for stopping the operation of the apparatus main body A when the detection result of the variation mode of the output signal of the home position sensor 59 and the reference signal stored in the ROM 113 do not match. That is, in the present example, the CPU 111 has a function of a stop means for outputting (transmitting) the signal for stopping the operation of the apparatus main body A when the intermediate transferring belt 51 not suited for the apparatus main body A is mounted.

Therefore, the image forming apparatus 100 of the present example has a comparison means (CPU) 111 for comparing the detection signal of the detecting means (home position sensor) 59 and the reference signal, similar to example 1. In the present example, the image forming apparatus 100 has a means for stopping the apparatus based on the comparison result of the comparison means (CPU) 111. Furthermore, the CPU 111 has a function of the recognition means for recognizing the type of the intermediate transferring belt 51 based on the detection signal of the home position sensor 59. That is, the CPU 111 has a notification means for notifying the information related to the intermediate transferring belt 51 based on the recognition result of the recognition means. Detailed description will now be given below.

Figure 9:
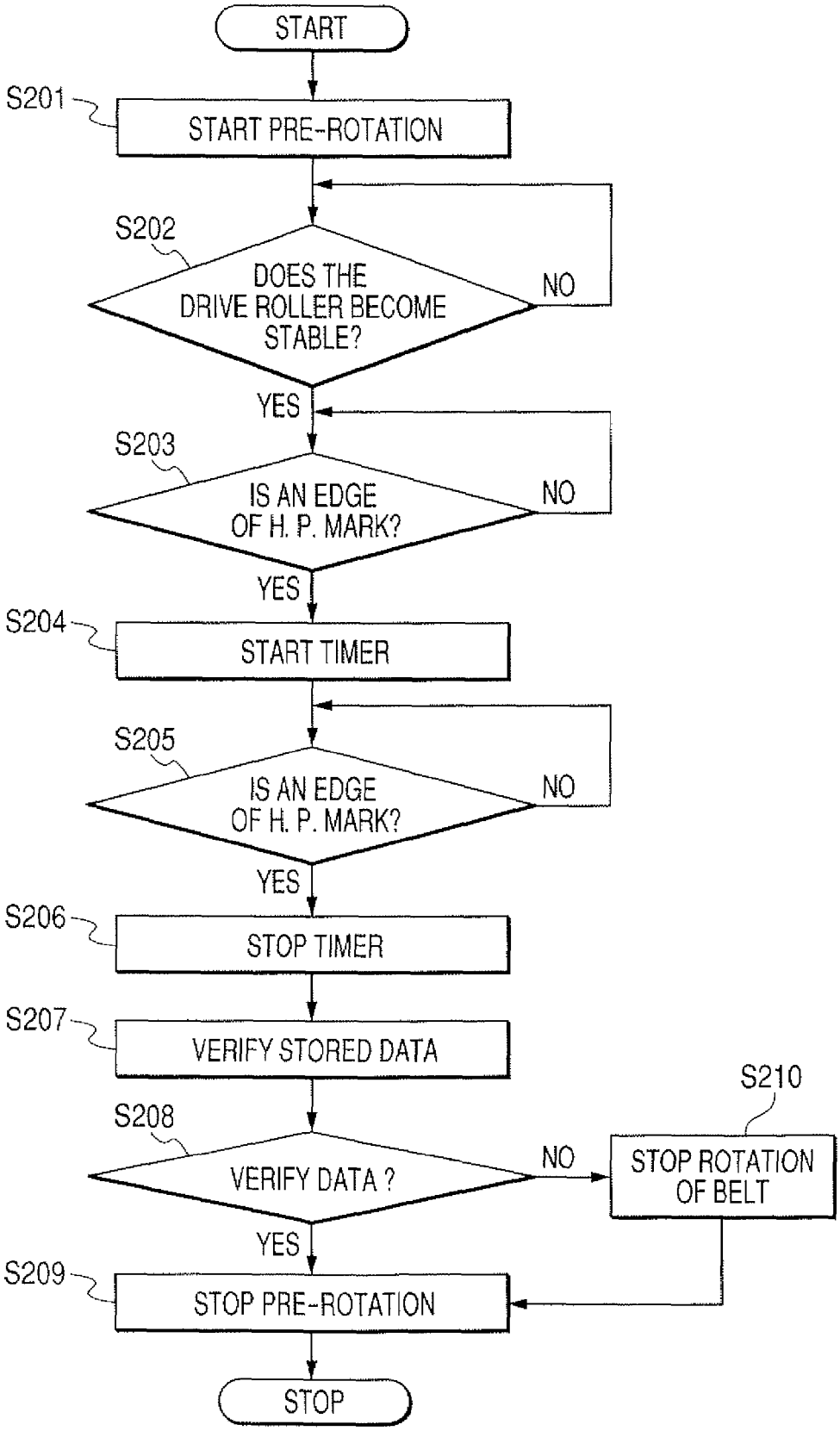
FIG. 9 is a flow chart showing an operation procedure of the suitability determination control of the belt member according to the present invention.

FIG. 9 is a flow chart showing the control in such case. In the flow chart of FIG. 9, S201 to S209 are the same as in example 1 shown in FIG. 7. In the present example, the CPU (comparison means, stop means) 111 transmits (S210) the stop signal to the drive motor 12 for driving the drive roller 52 when determining that the time data and the reference time data do not match in S208, and stops the pre-rotation (S209). The CPU 111 may transmit the stop signal to each section of the apparatus main body A other than the drive motor 12.

Therefore, according to the present example, the difference such as in model and version of the belt member are detected by the home position sensor 59 without adding a special hard configuration, and the image forming apparatus 100 is forcibly stopped. The effects similar to example 1 are then obtained.

EXAMPLE 3

Another example of the present invention will now be described. The basic configuration and operation of the image forming apparatus of the present example are the same as those of examples 1 and 2. Therefore, the same reference numerals are denoted for elements having the same or equivalent function as the image forming apparatus of example 1, and the detailed explanation thereof will not be described. The characteristic aspects will be described in the present example.

In examples 1 and 2, an example of measuring the interval time (width X of home position mark) from the rise to the fall of the output signal when the home position sensor 59 detects the home position mark 58, as shown in FIGS. 4A and 4B, and comparing the same with the reference time has been explained.

Figure 10:
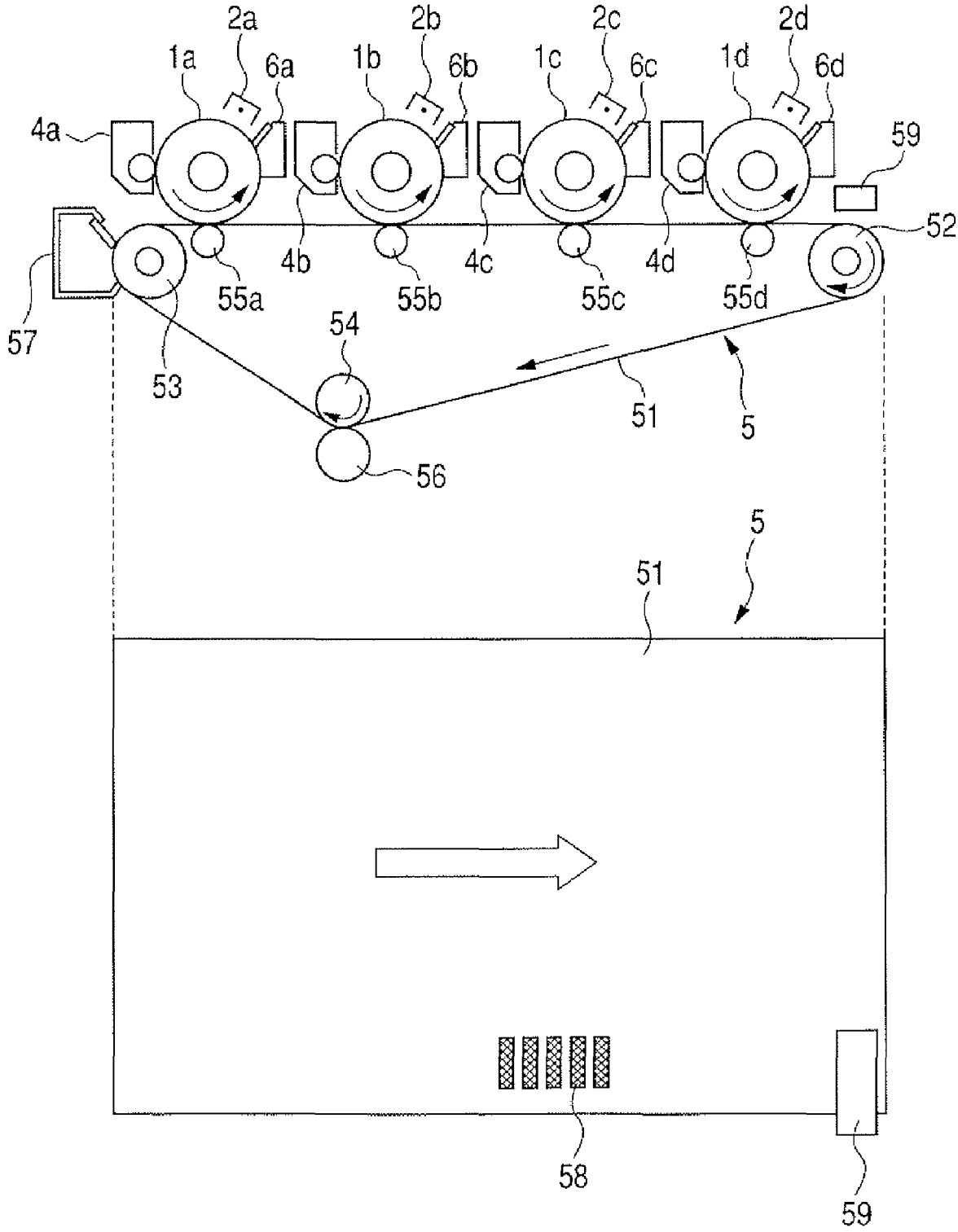
FIG. 10 is a cross-sectional view and a top view of the surrounding of the intermediate transferring belt for explaining another example of the home position mark.
Figures 11A, 11B:
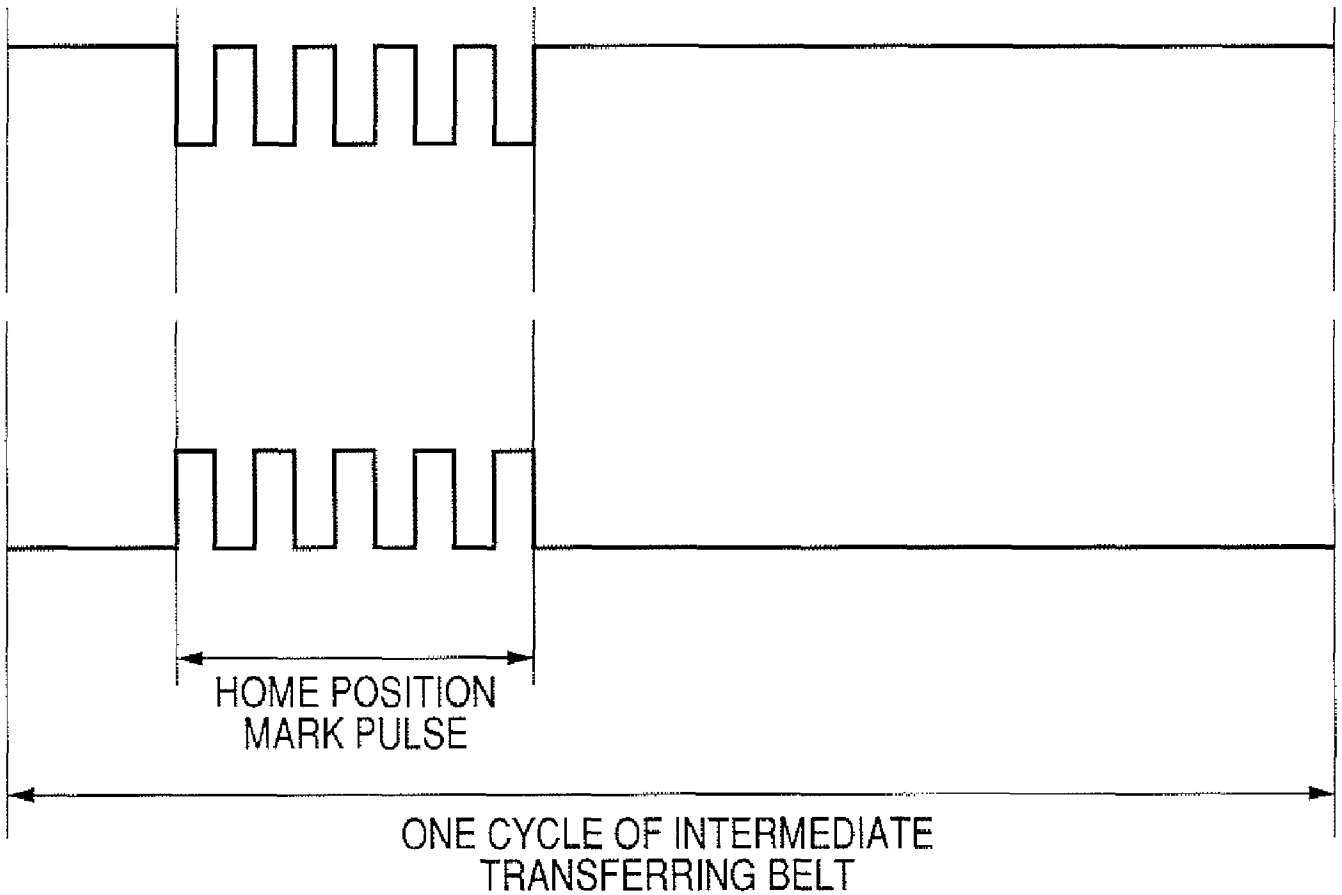
FIGS. 11A and 11B are explanatory views explaining another example of the output of the home position sensor.

In the present example, a plurality of high reflectivity parts and low reflectivity parts are alternately arranged on the home position mark 58 as shown in FIG. 10. FIGS. 11A and 11B are views showing the output of the home position sensor 59 when the high reflectivity part is detected at the home position mark section and when the low reflectivity part is detected at the home position mark section. As shown in FIGS. 11A and 11B, the number of pulses for the signal to change from the high reflectivity part to the low reflectivity part can be counted instead of comparing the interval time and the reference time. The number of pulses of the signal change and the reference number of pulses may be compared. The number of pulse is unique to the type of the intermediate transferring belt 51 corresponding to the suitability with respect to the apparatus main body A. In other words, in the present example, the number of variations in the output signal of the home position sensor 59 repeated over a plurality of cycles with the movement of the intermediate transferring belt 51 indicates the information related to the type of the intermediate transferring belt 51.

The control mode in this case is substantially the same as that of example 1 shown in FIG. 5, but the CPU 111 counts the number of pulses by means of a counter in place of the timer circuit 112.

Effects similar to examples 1 and 2 are also obtained by the method of the present example.

EXAMPLE 4

Another further example of the present invention will now be described.

The present invention is applied to the intermediate transferring belt 51 in the image forming apparatus 100 in examples 1 to 3. However, the present invention is not limited thereto, and similar effects are obtained even if the belt member is a different belt member such as a photosensitive belt, a conveying belt, and a fixing belt.

Figure 12:
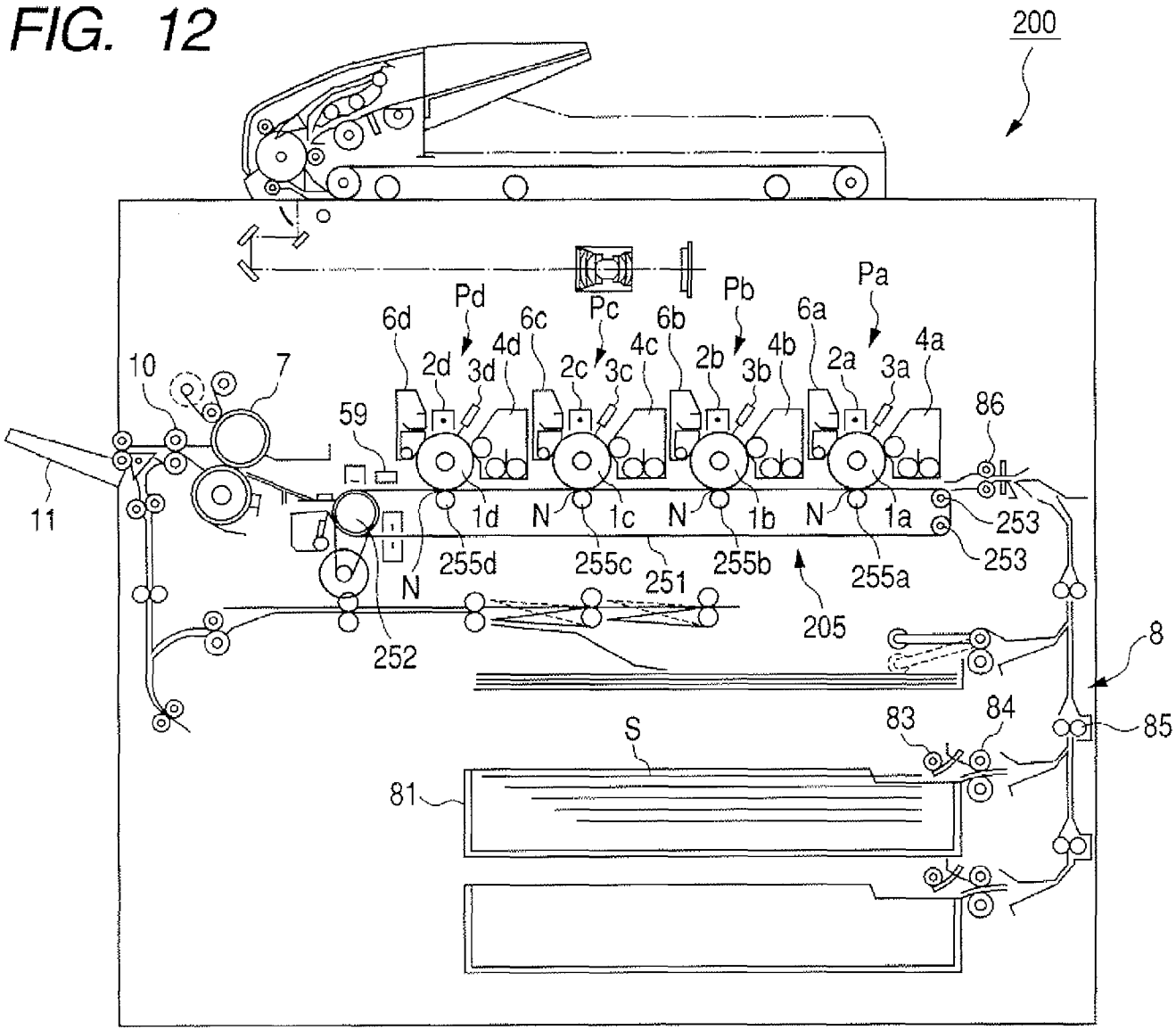
FIG. 12 is a main cross-sectional view of another example of the image forming apparatus according to the present invention.

FIG. 12 is a main cross-sectional view of an image forming apparatus 200 including a conveying belt 251 which is a recording material bearing member serving as an exchangeable belt member that moves endlessly. In other words, the present invention is applied to the conveying belt 251 serving as the belt member in the present example.

In the image forming apparatus 200 shown in FIG. 12, the same reference numerals are denoted for the elements having the same or equivalent function or configuration as the image forming apparatus 100 shown in FIG. 1, and the detailed description thereof will not be described.

The recording material S supplied from the cassette 81 is electrostatically attracted to the conveying belt 251 after registration corrected by means of the registration roller 86. The conveying belt 251 is stretched across the drive roller 252 and two driven rollers 253, 253, and is endlessly moved (traveled) in the direction (counterclockwise direction) shown with an arrow in the figure. The toner image is formed on the photosensitive drums 1*a* to 1*d*. The recording material S is sequentially transferred with the toner image by the transfer rollers 255*a* to 255*d* while being conveyed in a state electrostatically attracted to the conveying belt 251. The full color toner image is thus formed on the recording material S. Thereafter, each operation of separation, fixation, and discharge are performed, and the printing operation is terminated similar to example 1.

The home position mark is also arranged on the conveying belt 251 of the relevant image forming apparatus 200 similar to the intermediate transferring belt 51 of examples 1 to 3. The home position sensor 59 is arranged in the apparatus main body A similar to examples 1 to 3. Furthermore, a control configuration related to the detection of the home position mark is provided similar to examples 1 to 3. Thus, the same control as described in examples 1 to 3 is substantially performed, and similar effects are obtained.

The present invention has been described based on specific examples, but the present invention is not limited to the above-described embodiment. For example, the present invention is equally applicable to the so-called 1-drum type image forming apparatus mentioned above.

It should be apparent to those skilled in the art that the present invention may be embodied in many other specific forms without departing from the spirit or scope of the invention. Therefore, the present invention is not to be limited to the details given herein, but may be modified within the scope and equivalence of the appended claims.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-266128, filed Sep. 13, 2005, which is hereby incorporated by reference herein in its entirety.

What is claimed is:

1. An image forming apparatus comprising:

a rotatable belt member;

a driving force source that provides a driving force to said rotatable belt member;

a mark that is provided on said rotatable belt member;

a detection member that detects said mark;

a memory portion that stores a predetermined shape of said mark;

a distinguishing portion that determines the shape of said mark provided on said belt member, based on an output of said detection member and a moving speed of said rotatable belt member;

a comparison portion that executes a comparison between a determined shape of said mark on said rotatable belt member and the predetermined shape of said mark stored in said memory portion; and a notification portion that outputs a warning signal information regarding said belt member in a case where a determined shape of said mark on said rotatable belt member is different from the predetermined shape of said mark stored in said memory portion.

2. An image forming apparatus according to claim 1, wherein said mark detection member comprises an optical sensor.

3. An image forming apparatus according to claim 1, further comprising a drive member that transmits a driving force of said driving force source to said rotatable belt member, wherein the determination is executed in a condition where a rotation of said drive member is stable.

4. An image forming apparatus according to claim 1, wherein a glossiness of said mark is different from a glossiness of rotatable belt member.

5. An image forming apparatus according to claim 1, further comprising:

an image bearing member; and toner image forming means that forms a toner image onto said image bearing member, wherein said rotatable belt member includes an intermediate transferring member that bears a toner image transferred from said image bearing member.

6. An image forming apparatus according to claim 1, wherein said belt member includes a conveyance belt that conveys a recording material.

7. An image forming apparatus according to claim 1, further comprising:

toner forming means that forms a toner image on the recording material; and a fixing device that fixes a toner image on the recording material, wherein said rotatable belt member includes a fixing belt.

8. An image forming apparatus according to claim 1, wherein the comparison is executed by comparing a length of said mark in a rotation direction of said rotatable belt member and a length of said rotatable belt in the rotation direction of said rotatable belt member.

9. An image forming apparatus comprising:

a rotatable belt member;

a driving force source that provides a driving force to said rotatable belt member;

a mark that is provided on said rotatable belt member;

a detection member that detects said mark;

a memory portion that stores a predetermined shape of said mark;

a distinguishing portion that determines the shape of said mark provided on said belt member, based on an output of said detection member and a moving speed of said rotatable belt member;

a comparison portion that executes a comparison between a determined shape of said mark on said rotatable belt member and the predetermined shape of said mark stored in said memory portion; and a drive control portion that stops transmitting a driving force to said rotatable belt member in a case where a determined shape of said mark on said rotatable belt member is different from the predetermined shape of said mark stored in said memory portion.

10. An image forming apparatus according to claim 9, wherein said mark detection member comprises an optical sensor.

11. An image forming apparatus according to claim 9, further comprising a drive member that transmits a driving force of said driving force source to said rotatable belt member, wherein the determination is executed in a condition where a rotation of said drive member is stable.

12. An image forming apparatus according to claim 9, wherein a glossiness of said mark is different from a glossiness of said rotatable belt member.

13. An image forming apparatus according to claim 9, further comprising:

an image bearing member; and toner image forming means that forms a toner image onto said image bearing member, wherein said rotatable belt member includes an intermediate transferring member that bears a toner image transferred from said image bearing member.

14. An image forming apparatus according to claim 9, wherein said belt member includes a conveyance belt that conveys a recording material.

15. An image forming apparatus according to claim 9, further comprising:

toner image forming means that forms a toner image on the recording material; and a fixing device that fixes a toner image on the recording material, wherein said rotatable belt member includes a fixing belt.

16. An image forming apparatus according to claim 9, wherein the comparison is executed by comparing a length of said mark in a rotation direction of said rotatable belt member and a length of said rotatable belt in the rotation direction of said rotatable belt member.

17. An image forming apparatus according to claim 1, wherein the comparison is executed by comparing a determined gloss pattern of said mark and a stored gloss pattern of said mark.

18. An image forming apparatus according to claim 9, wherein the comparison is executed by comparing a determined gloss pattern of said mark and a stored gloss pattern of said mark.

* * * * *